United States Patent [19]

Takayasu

[11] 4,006,072

[45] Feb. 1, 1977

[54] DEVICE FOR ELIMINATING IMPURE IONS IN CHROMIUM PLATING BATH

[76] Inventor: Kiyoteru Takayasu, 617 Nimyo-cho 1980-banchi, Nara, Nara, Japan

[22] Filed: June 2, 1975

[21] Appl. No.: 583,039

[52] U.S. Cl. ..... 204/238; 204/232; 204/290 R

[51] Int. Cl.[2] ..... C25C 1/10; C25D 3/04

[58] Field of Search ..... 204/130, 231, 232, 237, 204/238, 240, DIG. 5, 290 R; 250/528

[56] References Cited

UNITED STATES PATENTS

| | | | |
|---|---|---|---|
| 2,652,925 | 9/1953 | Vermeiren | 204/DIG. 5 |
| 3,061,537 | 10/1962 | Yagashita | 204/130 |
| 3,457,152 | 7/1969 | Maloney, Jr. | 204/130 |
| 3,839,180 | 10/1974 | Takaysu | 204/238 |

*Primary Examiner*—T. M. Tufariello

[57] ABSTRACT

This disclosure relates to a device for eliminating impure ions in chromium plating bath such as Sargent bath or Chromate bath. Also, the disclosure relates to specific anode used therein and chromium plating system combined with the device. According to the device, the impure ions such as those of Fe, Ni, Cu, Pb, Zn, etc. are eliminated from the bath in the form of slime which mainly precipitates on or around the anode under the condition of DC 1 to 10 volt between the electrodes and anode current density of 1 to 100 A/dm$^2$.

17 Claims, 7 Drawing Figures

DEVICE FOR ELIMINATING IMPURE IONS IN CHROMIUM PLATING BATH

BACKGROUND OF THE INVENTION

This invention relates to a device for eliminating impure ions in chromium plating bath and more particularly to a device for eliminating impure ions such as those of Fe, Ni, Pb, Cu, Zn which are ionized in the chromium plating bath and deteriorate the efficiency of plating, in the form of slime which precipitates on anode/s.

This invention also relates to an anode used in conjunction with the above-mentioned device.

This invention further relates to a chromium electroplating system combined with the above-mentioned device.

The chromium plating bath in the following description refers to chromium electroplating bath inclusive of ordinary chromium plating and hard chromium plating and a Chromate bath. The following description is generally made taking examples of the former chromium plating bath.

As for the chromium plating bath, usually so-called closed system is adopted, in which the plating bath is recirculated continuously to be regenerated since chromic acid is of rather higher cost. A well-known closed system is electric chromium plating is such that wasted water in a water-washing tank is condensed in a vacuum heator condensor and the condensed liquid content is fed back to the plating bath through a reservoir tank when the chromic acid content comes nearly to that of the plating bath, while evaporated water content in the condensor is condensed to water and again returned to the water-washing tank. This system is economical in that the chromium plating bath can be recirculated to be used in a long period of time and also $Cr^{6+}$ is not discharged outside whereby it is free from pollution problem.

But a serious problem which resides in the above-mentioned plant is that by the chromium electroplating operation over a long period of time, foreign metal ions such as those of Fe, Ni, Pb, Cu, Zn (hereinafter referred to as impure ions) which are ionized from the article to be plated to the bath in the course of plating operation come to increase to deteriorate the efficiency of plating so that better chromium electrode position is not expected after a long period whereby the used bath is subject to be discharged outside as waste liquid.

A countermeasures taken today for eliminating such impure ions is to provide so-called Diaphragm electrolysis device in which an unglazed pottery cylinder or an porous resin cylinder of tetrafluoroethylene is partitioned in the plating tank in the cylinder of which water solution of chromic acid exclusive of $H_2SO_4$ is disposed and a cathode is immersed in the solution while on the anode side is disposed ordinal chromium plating bath inclusive of $H_2SO_4$ thereby to make the above-mentioned impure ions precipitated on the cathode side during electrolysing. However, this device entails such disadvantages as not only troublesome operation and hard administration of operation but also higher material cost since chromic acid liquid is used inside of the cylinder as an operation liquid separated from the plating bath per se.

BRIEF SUMMARY OF THE INVENTION

The primary object of the invention is, therefore, to provide a device for eliminating impure ions in a chromium plating bath, which is adpated to efficiently eliminating electrochemically the impure ions such as those of Fe, Ni, Pb, Cu, Zn which are ionized in the chromium plating bath without the use of a diaphragm device.

Another object of the invention is to provide the abovementioned device which enables to precipitate the impure ions are slime on or around the anode having the specific structure.

A further object of the invention is to provide the above-mentioned device which does not deteriorate chromium plating per se even though it is combined with a chromium plating tank in the plating process.

Still a further object of the invention is to provide the above-mentioned device which is continuously operatable under no administration.

Yet still a further object of the invention is to provide the above-mentioned device which is capable of being used over a long period of time without deterioration of the chromium plating bath even though the device is used in combination with the aforesaid closed chromium plating system.

An additional object of the invention in conjunction with the above-mentioned objects is to provide the above-mentioned device having a simple construction and being economical in that electric power consumption is rather low.

Still an additional object of the invention is to provide anode/s having specific structure to be used for the above-mentioned device.

An even further object of the invention is to provide a chromium plating system in combination with the above-mentioned device.

Other objects and advantages of the invention will become apparent from the following description of the accompanying drawings with reference to the preferred examples embodied in the invention.

DETAILED DESCRIPTION OF THE PREFERRED EMBODIMENTS

Figure 1:
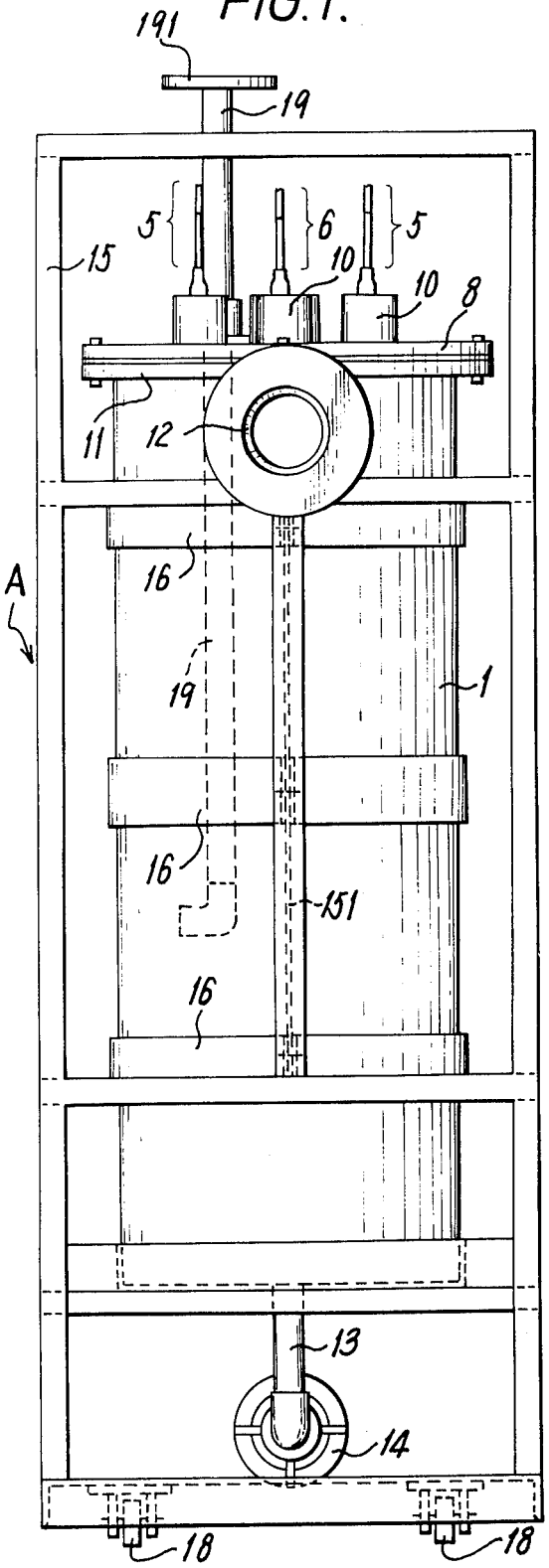
FIG. 1 is a front view of one example of a device according to the invention.
Figure 2:
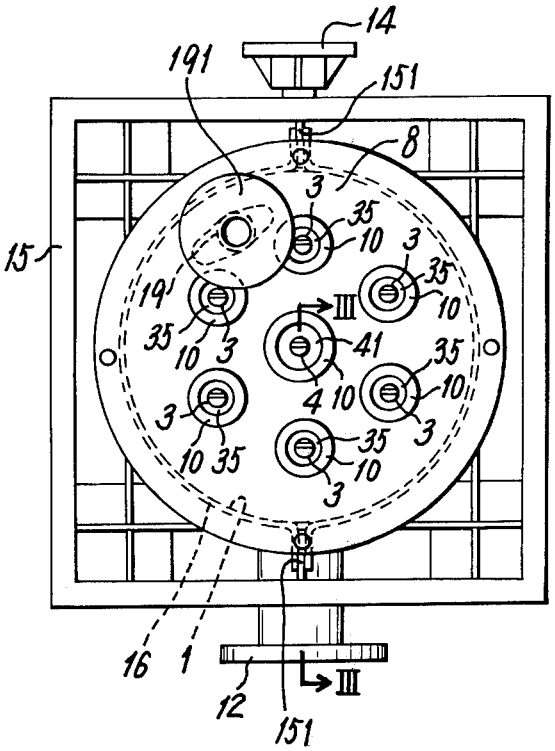
FIG. 2 is a plan view of the same.
Figure 3:
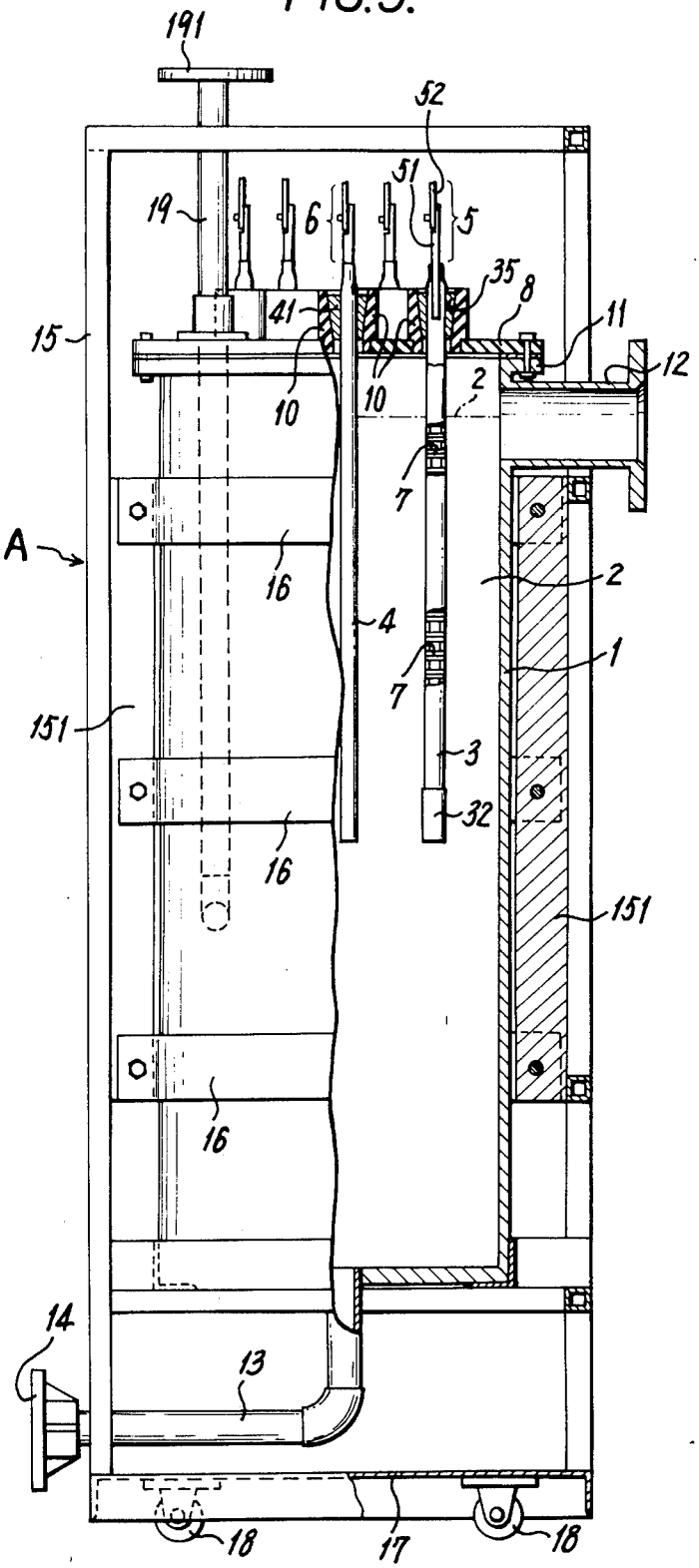
FIG. 3 is a side elevation inclusive of a cross section taken along the line III—III of FIG. 2.

In the drawing, a device A of the present invention comprises an electrolyte tank, a chromium plating bath 2 disposed in the tank, anode 3 and a cathode 4 which are immersed in the bath 2 and power supply means 5, 6 which are adapted to supply direct current electricity to the electrodes 3, 4.

Figure 4:
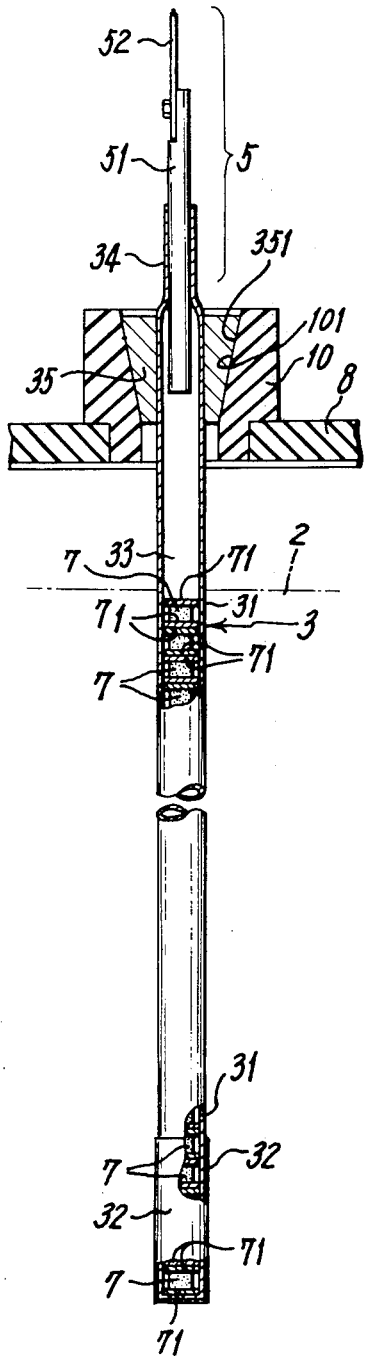
FIG. 4 is an enlarged front view of an electrode (an anode) for eliminating impure substances of the invention.
Figure 5:
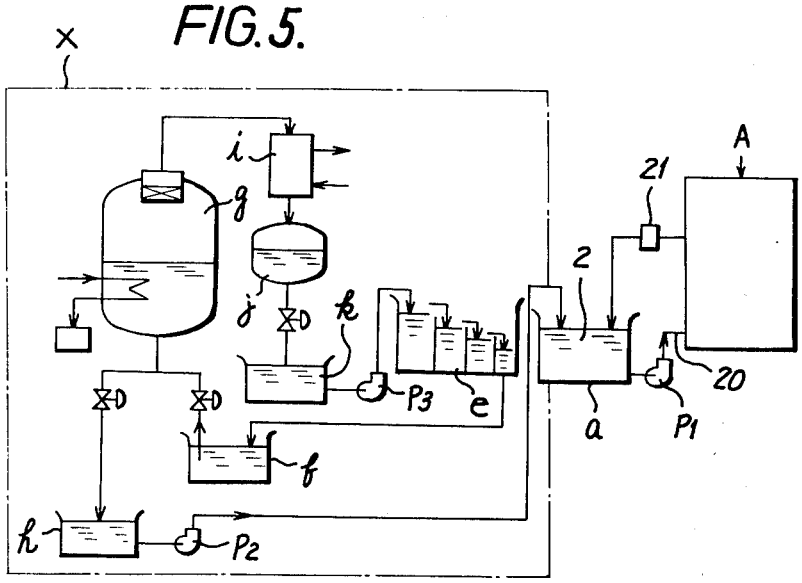
FIG. 5 is a flow chart of a closed chromium plating system in combination with the above-mentioned device.
Figure 6:
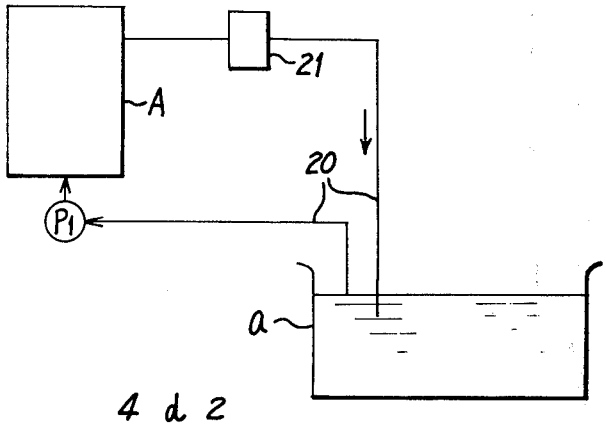
FIG. 6 is a flow chart of a chromium plating according to another embodiment of the invention.
Figure 7:
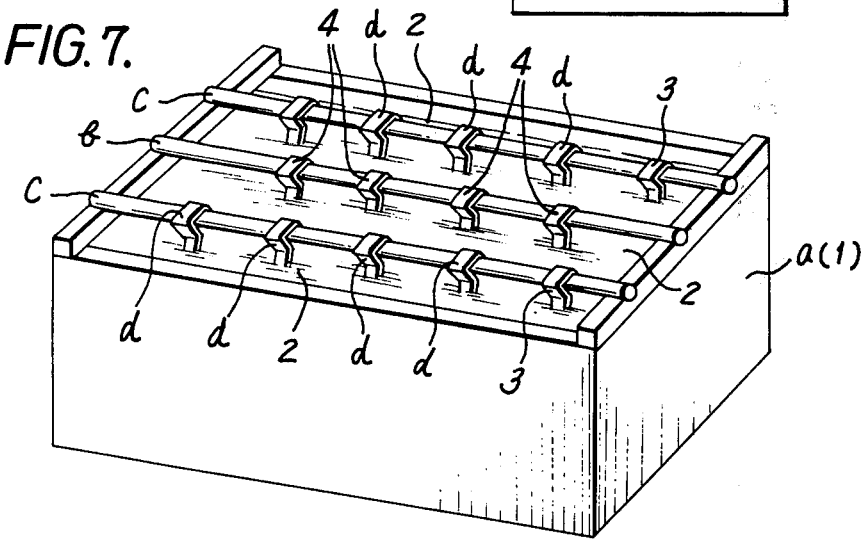
FIG. 7 is a schematic front view of a device according to still a further embodiment of the invention.

The device shown in FIG. 1 to FIG. 4 is separated from the chromium plating tank *a* in the plating process as is apparent from FIG. 5 and FIG. 6. On the other hand, the device in FIG. 7 is the example that the chromium plating tank *a* per se includes the device of the present invention. The means which plays the main role in eliminating impure ions in the present invention is the anode having specific structure. The anode 3 comprises a base metal 31 of corrosion-resistant material selected from the group consisting of Ti, Zr, Nb, Ta, their alloys and Ni alloy, an active layer 32 of a noble metal and its alloy selected from the group consisting of Pt, Pd, Ru, Ph, Ir, Os and their alloys formed by electroplating, vacuum evaporation plating or clad technique onto the lower surface of the base metal 31 and a magnetic means 7 to impart magnetic field to the plating bath 2 around the anode 3. The noble metal may be formed on the entire surface of the metal 31 but from the economical point of view, it is sufficient to be formed partially onto the lower surface of the anode 3 to.

In the embodiment of FIG. 1 to FIG. 4 as mentioned before, the device of the invention is assembled separate from the chromium plating tank 1. In detail, the device A of this embodiment comprises an electrolyte tank 1 in the form of a cylinder having a bottom, a chromium plating bath 2 disposed in the tank 1, a cylindrical bar shaped cathode 4 which is positioned at approximately the center of the tank 1 immersed in the plating bath 2, said cathode 4 being made of any of Pb, Pb alloy, Ag alloy, Fe and Fe alloy, six anodes 3 which are arranged radially around and equidistant from the cathode 4. Each anode 3 is in the form of a slim pipe having a bottom as shown in FIG. 1 to FIG. 4, a magnet means 7 including a plurality of permanent magnets (preferably ferrite magnets) in a series connection in an inner hollow 33 of the anode 3 along the longitudinal direction thereof and power supply means 5, 6 connected to the top of the cathode in order to supply direct current. Means for holding the anode, shown in FIG. 1 and FIG. 4, include a socket 10 having an inner conical wall 101 of insulating material which is tapered to the downward direction and secured to the anode 3. Socket 10 passes through lid 8 which covers the electrolyte tank 1. At the top of the anode 3 is formed a compressed portion 34 to which a bus bar 51 of a conductive material is fixed to be pressed, to the lower side of said compressed portion 34 is fixed a hanger member 35 of corrosion-resistant material (Ti, Nb, etc.) having a conical outer wall 351 which is tapered to the downward direction and correspondes with the cylindrical inner wall face 101 of the socket 10. In this embodiment, the anode 3 is suspended from the lid 8 by the engagement of the hanger member 35 with the socket 10. Similarly, a means for holding the cathode 4 is suspended from the socket 10 and a hanger member 41 both having the same structure as that of the anode 3. To the buss bar 51 of the anode 3 is connected a terminal metal 52 to construct a power supply means 5 and in the same manner, a power supply means 6 to the cathode 4 is constructed.

The electrolic chromium plating bath 2 is, for instance, Sargent bath which is used for luster chromium plating bath and hard chromium plating bath sonsisting of chromium trioxide (chromic anhydride) and sulfuric acid, however, the composition of the plating bath 2 is not to limit the scope of the invention and may be of any kind adapted for the chromium plating.

Also, as for the metal material of the active layer, for instance, platinum alloy is refined from magnetic pyrites ore of Canadian product (Pt 2%, Pd 2%, Rh 0.2%, Ru 0.2%, IR 0.04% and Os trace) or platinum ore of Ural product (Pt 77.5%, Ir 1.45%, Rh 2.8%, Pd 0.85%, Os 2.35%, Cu 2.15%, Fe 9.6% and sand 1%) and osmiridium alloy is refined from osmilidium ore (Ir 52.5%, Os 27.2%, Pt 10.1%, Ru 5.9%, Rh 1.5%, Pd trace, Cu trace and Fe trace).

The magnet means 7 is arranged, as shown in FIG. 4, in such a manner that a soft steel piece 71 is interposed between adjacent magnets 7—7 so that the counterpolarities are obtained. This is based on the consideration that the fluctuation of the density of the magnetic field due to temperature variation may be controlled.

The tank 1 has on the lower side thereof an inlet 14 in which the plating bath 2 is conducted through a pipe 13 and an outlet 12 on the upper side thereof and further, has a yoke 15 encircling the tank 1, to a longitudinal rib wall 151 of the yoke 15 being provided three bands 16 for securing the tank 1, each positioned in the longitudinal direction thereof. The tank 1 is secured by the bands along the periphery thereof. At the lower portion of the yoke 15 is provided a support base 17 having a caster 18 at the lower portion thereof which is adapted to make movable the tank 1.

An air drain pipe 19 in the tank 1 is provided passing through the tank 1 and the lid 8, the top of the pipe 19 being usually closed by a flange 191 except when air drain is desired, at which the flange 191 is adapted to be removed. The lid 8 is adapted to be connected by bolts to the flange 11 provided at the top end of the tank 1.

Another embodiment of this invention is shown in FIG. 7, in which the chromium plating tank *a* is assembled in association with the device of the invention. In this embodiment, the device comprises the chromium plating tank *a*, a plating bath 2 in active plating process, a plurality of cathodes 4 for chromium plating, said cathodes, namely, the article to be plated, being suspended from a minus pole bar *b* and the anodes 3 hung on a rod *c* assembled separate from the anodes *d* (usually Pb electrode) for chromium plating. In FIG. 7, an anode 3 is respectively applied to the anode rods *c*, *c*. Four of the cathodes 4 are suspended from the cathode rod *b* and eight of the anodes *d* for plating are suspended from the anode rods *c c*.

As is apparent from this construction, the device of the embodiment is of quite simple construction in that only the anodes 3 is added to the same anode rods in a well-known chromium plating device.

Two embodimental manners of usages of the device according to this invention may be applied in which the former one is that the device is assembled in a series with the closed plating system in FIG. 5 and the latter one is that the device is assembled in a series with a badge-type chromium plating tank in FIG. 6. In the former case, the tank *a* and the device A are assembled in a series through the looped pipe passageway of the chromium plating bath so that the plating bath 2 is continuously delivered to the device A of the embodiment in FIG. 1 to FIG. 4 by a pump means $p_1$ and a piping means 20 and feeding back the bath from the device A to the tank *a* and thereby recirculating the bath through the tank *a* and the device A. The plating tank *a* in the embodiment is associated with closed chromium plating system encircled by a chain line X in the FIG. 5.

A mesh filter 21 for filtering slime, which is made of any material selected from the group consisting of Ti, Zr, Nb, Ta, their alloys and Ni alloy is interposed in the way of the piping means 20. In detail of the system, used water in water washing tank *e* is fed to be reserved in a reservoir tank *f* and the water is then fed to a vacuum evaporation condensor *g* having steam or electric heating means. The condensed liquid content in the condensor *g* is reserved in another reservoir tank *h* and the evaporated content is condensed in a condensor *i* to be distilled water, which is reserved in a drain tank *j* and thereafter fed to another reservoir tank *k*. The distilled water in the tank *k* is fed back to the water-washing tank *e* through a pump means $p_3$. While, the condensed liquid content in the reservoir tank *h* is delivered back to the plating tank *a* through a pump means $p_2$. Such closed plating system X is well-known and it is understood that the device A of the invention arrange as shown in FIG. 5 associates with the closed system.

Similarly, the device of this embodiment may be interposed between the piping passageway of the reservoir *h* and the plating tank *a*. In the plant shown in FIG. 6, the independent plating tank *a* and the device A are combined completely in the same manner as those in FIG. 5.

In the embodiment of FIG. 7, the plating tank *a* per se serves as the device A of the invention, so that the piping means and the pump means are omitted between the plating tank *a* and the device A.

The operation of the present device is described hereinafter.

In either way of applicable manners of the invention as before explained, DC 1 to 10 V is impressed between the anode 3 and the cathods 4 and the chromium plating bath 2 is electrolysed at the anode electric current density of 1 to 100A/dm$^2$. By the conduct of the electric current, the active layer 32 of the anode is electrically activated and a magnetic field is given to the bath 2 around the anode 3 by the magnetic means 7.

In the proceeding of the electrolysis, colloidal slime particles precipitate at first on the surface of the active layer 32 of the anode 3. The slime then extends gradually to the surface of the upper base metal 31 on which no active layer 32 is formed but in a range of the influence of magnetic field by the magnet means 7. Simultaneously on the surface of the active layer is participated a new slime in more density and this moves to the adjacent surface of the base metal. In the case where the Fe, Ni ion density in the bath 2 is high enough, almost all slime precipitates which tends to be adsorbed on the surface of the anode 3, but to the contrary, in the case where they are low but the Cu, Pb, Zn ion density is high enough, the precipitated slime tends to float on the surface of the bath 2 or otherwise to suspend in the bath 2.

According to the naked eye observation, the slime is rather large colloidal one much different from that in the known Diaphragm method. Further, the slime is dry and water-slashable. The slime after washed by water and dried is presented for the atomic absorption analysis by which it is found to be an intermetalic compound of Fe, Ni, Cu, Ph, Zn.

Another characteristic feature of the operation by the device of the present invention is that, the $Cr^{3+}$ ion density in the bath does not substantially vary with the precipitation of the slime and the $Cr^{3+}$ ion is hardly included in the slime according to the beforesaid analysis. In conjunction with this phenomium, any change does not occur in the growth of the thickness of the chromium plating film obtained by the electrolysis in the plating bath of the device of the invention. Accordingly, the present device is advantageous in eliminating impure ions by electrolysis but it does not deteriorate at all with the chromium plating per se.

The inventor can regrettably present neither theoretical view nor analysis with regard to the electrolysis functional organization according to the present invention. Pursuant to the common knowledge, it is considered that cations such as those of Fe, Ni, Cu, Pb, Zn are to electrodeposite on the cathode 4, however, to the contrary, in the case of the present device, they actually precipitate on or around the anode 3 as slime. Similarly, $Cr^{3+}$ does not precipitates either on the cathode 4 nor the anode 3, the fact of which is a phenomenon beyond inference from theory. It can be assumed that a great deal of nascent oxygen develops around the anode 3 and the ions those of Fe, Ni, Cu, Pb, Zn are oxidized by the oxygen to be slime consisting of respective oxides which are chemically stable. Among the slime that including much Fe and Ni which are magnetic substances is magnetized by magnetic field enough to be adsorbed on the surface of the anode 3 resisting to circulating flow of the bath 2 in the tank 1. In the case where Fe and Ni are not so much, even if they are magnetized, they can hardly resist against the circulating flow and are subject to suspend in the bath 2 or float on the bath 2. $Cr^{3+}$ may be oxidized to be $Cr^{6+}$ which composes chromic acid anhydride and may be ionized in the bath so that chromium ion density desired for chromium plating is maintained.

From the above-mentioned analysis by atomic absorption is turned out that Fe content contained in the slime is magnetite likely to ferrite series and also by the electro-microscope observation, it is found to be of $\gamma$ type. From these results of observations, a reason that the slime is adsorbed on the surface of the anode 3 in the range of influence of the magnetic field can be recognized.

Some concrete examples with numerical values of the invention are described hereinafter.

(Example 1)

i. bath to be used; Sargent bath
composition . . . chromic acid anhydride 230g/litre
$H_2SO_4$ 10% (wt%)
bath temperature; 57° C
bath volume; 1,500 litre
application of bath; luster chromium plating impure ions' density in the bath . . .
Fe . . . 259mg/kg
Cu . . . 28800 mg/kg
Zn . . . 8060mg/kg
Ni . . . 2640 mg/kg
Pb . . . 20.1 mg/kg
$Cr^{3+}$ . . . 1500 mg/kg ii. construction of the device; that in FIG. 1 to FIG. 4 anode . . . six anodes in all, each anode being shaped in a pipe having a bottom of 25 mm $\phi$ in the inner diameter, 1 mm in the thickness, 540 mm in the length in the tank. Each anode is provided with a base metal of Ti and about 2$\mu$ in the thickness of an active layer of Pt is plated over the base metal in the range of 50 mm from the lowest end of the pipe. Twenty of ferrite magnets of Mn-Zn series, each being 20 mm in the diameter and 12 mm in the thickness are piled toward the upward direction from the lowermost bottom of the pipe respectively interposing a soft steel plate of 5 mm in the thickness and 22 mm in the diameter. The magnetic characteristic of each magnet is approminately $B_R$ 600G, Hc 0.05 Oe.

cathode . . . pure Pd cathode iii. Application manner of the device; that shown in FIG. 6.

iv. electrolysis conditions of the device voltage . . . 4.5 V electric current density of each anode . . . 5.5 A/dm$^2$ (33 A/dm$^2$ in total of six anodes)

immersion length of anode into bath . . . 500 mm electrolysis time length . . . 99hrs.

v. article to be plated in the plating tank workpiece . . . shell vessel of a thermos to which is given previously Cu-Ni plating on brass plating plating interval . . . workpiece is replaced by a new one in every 5 minutes vi. impure ions' density of bath in the device after electrolysis;

Fe . . . 234mg/kg
Cu . . . 22000 mg/kg
Zn . . . 4680 mg/kg
Ni . . . 2130 mg/kg
Pb . . . 19.5 mg/kg
$Cr^{3+}$ . . . 14300 mg/kg 1 vii. slime on the anode slime volume . . . 16 mg component rate of slime by atomic absorption analysis;

Fe . . . 3.5% (wt%)
Cu . . . 24.3 (wt%)
Zn . . . 7.1 (wt%)
Ni . . . 53.5 (wt%)
Pb . . . 11 (wt%)
Cr . . . 1 (wt%)

(Example 2)

i. bath to be used composition; same as in the Example 1 bath temperature; same as in the Example 1 bath volume; same as in the Example 1 application of bath; same as in the Example 1 impure ions' density in bath

Fe . . . 17700 mg/kg
Ni . . . 15600 mg/kg
Pb . . . 30.5 mg/kg
Cu, Zn . . . unable to be measured
$Cr^{3+}$ . . . 17200 mg/kg ii. construction of the device; same as in the Example 1 iii. application manner of the device; same as in the Example 1 iv. electrolysis conditions of the device; same as in the Example 1 v. article to be plated in the plating bath workpiece . . . a frying pan on which is given Ni double platings vi. impure ions' density of bath in the device after electrolysis;

Fe . . . 8600 mg/kg
Ni . . . 4700 mg/kg
Pb . . . 22.7 mg/kg
$Cr^{3+}$ . . . 1630 mg/kg vii. slime on the anode slime volume . . . 560 mg component rate of slime Fe . . . 45.5 %(wt)
Ni . . . 37 %(wt)
Pb . . . 17 %(wt)
Cr . . . 0.5 %(wt)

(Example 3)

i. bath to be used; same as in the Example 1 ii. construction of the device; that in FIG. 7 iii. application manner of the device; that in FIG. 7 iv. electrolysis conditions voltage . . . 6V electric current density of each anode . . . 15A/dm$^2$ electrolysis length of time . . . 3hrs.

v. article to be plated in the plating bath; same as in the Example 2 vi. impure ions' density of bath in the device after electrolysis; unable to measure due to continuing of the bath for plating vii. slime on the anode;

slime volume . . . 3mg slime analysis;

Fe . . . 45% (wt%)
Pb . . . 16% (wt%)
Ni . . . 39% (wt%)

(Example 4)

i. bath to be used; Chromate bath (waste liquid drawn from Chromate tank)

composition;

chromic acid anhydride . . . 5g/litre
$HNO_3$ . . . 6ml/litre
$H_2SO_4$ . . . 1 ml/litre bath temperature . . . 25° C bath volume . . . 100 litre impure ions' density in the bath Zn . . . 1.8 g/litre (bath with which desirable Chromate luster is no longer obtainable)

ii. construction of device; same as in the Example 1 iii. application manner of the device; same as in the Example 1

(Chromate tank and the device of the present invention are completely separated)

iv. electrolysis conditions of the device; that in the Example 1, whereas electrolysis length of time is 5 hrs.

v. Chromate content in the Chromate tank; Chromate plating for Zn alloy vi. impure ions' density of bath in the device after electrolysis;

Zn . . . 1.23 g/litre (the above-mentioned bath can be regenerated for ordinal Chromate luster plating)

vii. slime on the anode; The ring like slime is observed on the surface of the anode, however, the volume is not so large as to be detachable as mass from the anode. This may assumably be owing to that Zn oxides are much more evaporable than remaining slime.

From the above example, it appears that the device of the invention is very efficient in reducing impure ions such as those of Fe, Cu, Zn, Ni and Pd in chromium plating bath in the plating process or after the plating process and also the device does not change $Cr^{3+}$ value in the bath thereby not depriving of the principal faculty of plating or chromating, and henceforth, these facts of which should be highly evaluated as intrinsic merits of the invention.

Many advantages of this invention are summarized below:

i. The rate of eliminating impure ions is high.
ii. The assemble is exceedingly simple.
iii. Since the electric power necessary for plating per se is common in being impressed between the anode/s and the cathode of the invention, the electric power consumption is low.
iv. Unlike diaphragm method, it is unnecessary to provide superfluous liquid other than plating bath and to renew a diaphragm to avoid any reduction of eliminating efficiency due to any clogging of the old diaphragm, so that the present invention may enable continuous operation without specific technique and make it sure to carry out in a low cost.
v. Continuous operation is carried out in association with closed chromium electroplating system.

While there has been described what is considered to be the preferred embodiments of the invention, it will be understood that various changes and modifications may be made on the construction thereof, and it is intended to cover in the appended claims all such modifications as fall within the true spirit and scope of the invention. For instance, electro magnet can be adopted for the magnet means. Also, flat plate shaped anode is applicable. The number of the anode can be varied with the effective electrolysis area of the cathode applied, and further they can be increased especially for the same purpose as that of an auxiliary anode which is known as controlling $Cr^{3+}$ density.

What is claimed is:

1. A device for removing metal ion impurities from chromium plating baths without depletion of chromate ions comprising 1. an electrolytic tank operable to hold plating bath;
2. at least one cathode disposed within said tank for immersion in plating bath held therein;
3. a plurality of anodes disposed within said tank for immersion in plating bath held therein and spaced from said cathode, said anode (a) being a hollow member, the lower, immersible end portion of which is closed, said member being composed of a corrosion resistant base material selected from the group consisting of (i) titanium, zinc, niobium and tantalum and (ii) alloys of titanium, zinc, niobium, tantalum and nickel, (b) having an outer active layer over and in electrical contact with at least the lower closed end portion of said member, said layer being a material selected from the group consisting of (i) platinum, palladium, ruthenium, rhodium, iridium and osmium and (ii) alloys of platinum, palladium, ruthenium, rhodium, iridium and osmium, and (c) having magnetic means disposed within said hollow member operable to impart a magnetic field around said anode; and
4. means operable to apply an electrical potential between said cathode and anodes.

2. A device according to claim 1 wherein said magnetic means comprises a permanent magnet.

3. A device according to claim 1 wherein said magnetic means comprises an electromagnet.

4. A device according to claim 1 wherein said anode is cylindrical and said magnetic means comprises a plurality of individual magnets disposed within said cylinder along its main axis.

5. A device according to claim 1 in which said cathode is lead, iron, a lead alloy, a silver alloy or an iron alloy.

6. A device according to claim 1 in combination with an active chromium plating system comprising a plating tank and anodic electrodes, said plating tank constituting said electrolytic tank and said potential applying means being operable to maintain said anodes at the same electrical potential as said anodic electrodes.

7. A device according to claim 1 in combination with an active chromium plating system comprising a plating tank and anodic electrodes, said electrolytic tank and said plating tank communicating with each other through circulating loop piping means, said potential applying means being operable to maintain said anodes at the same electrical potential as said anodic electrodes.

8. A device according to claim 7 wherein said circulating loop piping means includes pumping means operable to pump plating bath from said plating system to said device and filter means operable to filter plating bath returning from said device to said plating system.

9. A device according to claim 8 wherein said filter means comprises a mesh filter of a material selected from the group consisting of (i) titanium, zirconium, niobium, tantalum, (ii) alloys of titanium, zirconium, niobium and tantalum, and (iii) ethylene cyanide.

10. A device according to claim 7 wherein said plating system further comprises washing means for cleansing plated articles, a vacuum evaporator, condenser means operable to condense such wash with recovery of water and means to recirculate said condensed wash to said plating tank and said recovered water to said washing means.

11. An anode for use in electrolytic removal of metal ion impurities from chromium plating baths comprising a base of corrosion resistant first metallic material with at least a portion of said first metallic material being covered with an active layer of a second metallic material selected from the group consisting of (i) platinum, palladium, ruthenium, rhodium, iridium and osmium and (ii) alloys of platinum, palladium, ruthenium, rhodium, iridium and osmium and having magnetic means disposed within said electrode operable to impart a magnetic field around said electrode.

12. An anode according to claim 11 wherein said first metallic material is selected from the group consisting of (i) titanium, zinc niobium and tantalum and (ii) alloys of titanium, zinc, niobium, tantalum and nickel.

13. An anode according to claim 11 wherein said magnetic means comprises a permanent magnet.

14. An anode according to claim 11 wherein said magnetic means comprises an electromagnet.

15. An anode according to claim 11 wherein said anode is cylindrical and said magnetic means comprises a plurality of individual magnets disposed within said cylinder along its main axis.

16. An anode according to claim 15 wherein said second metallic material is disposed on the lower portion of said anode and said plurality of magnets extends beyond said lower portion.

17. A device for removing metal ion impurities from chromium plating baths without depletion of chromate ions comprising 1. an electrolytic tank operable to hold the plating bath;
2. a lid operable to cover said tank;

3. at least one cathode centrally disposed on said lid for immersion in plating bath held in said tank;
4. a plurality of spaced anodes radially disposed on said lid around and equidistant from said cathode for immersion in plating bath held in said tank, said anode (a) being a hollow cylindrical member, the lower, immersible end portion of which is closed, said member being composed of a corrosion resistant base material selected from the group consisting of (i) titanium, zinc, niobium and tantalum and (ii) alloys of titanium, zinc, niobium, tantalum and nickel, (b) having an outer active layer over and in electrical contact with at least the lower closed end portion of said member, said layer being a material selected from the group consisting of (i) platinum, palladium, ruthenium, rhodium, iridium and osmium and (ii) alloys of platinum, palladium, ruthenium, rhodium, iridium and osmium, and (c) having a plurality of magnetic means disposed within said hollow member operable to impart a magnetic field around said anode in said bath;
5. means operable to apply an electrical potential between said cathode and anodes
6. hanger means operable to support said anodes and cathode on said lid;
7. inlet means operable to introduce plating bath to said tank; and
8. outlet means operable to discharge plating bath from said tank.

* * * * *